US006257927B1

(12) United States Patent
Suzuki et al.

(10) Patent No.: US 6,257,927 B1
(45) Date of Patent: Jul. 10, 2001

(54) MULTI-COAXIAL CONNECTOR HAVING A METALLIC BLOCK CONNECTED IN COMMON TO OUTER CONDUCTORS OF A PLURALITY OF COAXIAL CABLES

(75) Inventors: Takao Suzuki, Oume; Yoshihiro Sugii, Iruma, both of (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/433,278

(22) Filed: Nov. 3, 1999

(30) Foreign Application Priority Data

Nov. 4, 1998 (JP) ..... 10-313313

(51) Int. Cl.[7] ..... H01R 9/05
(52) U.S. Cl. ..... 439/579; 439/580; 439/608
(58) Field of Search ..... 439/579, 580, 439/581, 608, 63

(56) References Cited

U.S. PATENT DOCUMENTS

| | | | | |
|---|---|---|---|---|
| Re. 36,065 | | 1/1999 | Andrews et al. | 439/608 |
| 5,108,300 | * | 4/1992 | Weber | 439/188 |
| 5,842,872 | * | 12/1998 | Hosler et al. | 439/63 |
| 6,071,127 | * | 6/2000 | Acke et al. | 439/63 |

OTHER PUBLICATIONS

European Search Report (The Hague) completed Feb. 22, 2000 for Application No. EP 99 12 1862 and the following patents: (1) EP 0 862 243 A(Siemens AG); (2) WO 97 02629 A (Whitaker Corp); (3) U.S. Patent 4,659,156 dated Apr. 21, 1987 (Johnescu et al); (4) EP 0 582 960 A (Siemens AG); and (5) EP 0 488 482 A (DuPont Nederland; DuPont US).

* cited by examiner

*Primary Examiner*—Gary F. Paumen
*Assistant Examiner*—Alexander Gilman
(74) *Attorney, Agent, or Firm*—Laff, Whitesel & Saret, Ltd.; J. Warren Whitesel

(57) ABSTRACT

A multi-coaxial connector comprises a metallic die-cast block having a plurality of through-holes, a plurality of L-shaped contacts each having foot and leg portions, and a plurality of insulator sleeves. The through-holes hold the foot portions of the L-shaped contacts on the inside circumferences thereof, via the insulator sleeves, respectively. The L-shaped contacts serve as inner coaxial conductors, while the metallic block serves as a common outer coaxial conductor for the inner coaxial conductors. The connector further comprises an insulator housing which has an open rear end and additional through-holes corresponding to the through-holes. Such insulator housing accommodates the front end of the metallic block inserted thereinto through the open end, so as to serve as a cap of the metallic block.

17 Claims, 6 Drawing Sheets

MULTI-COAXIAL CONNECTOR HAVING A METALLIC BLOCK CONNECTED IN COMMON TO OUTER CONDUCTORS OF A PLURALITY OF COAXIAL CABLES

BACKGROUND OF THE INVENTION

This invention relates to a multi-coaxial connector for electrically connecting a plurality of coaxial cables to a connecting object such as a printed circuit board, and, in particular, to such a multi-coaxial connector which is fixed on and connected to the connecting object and which is removably coupled with a mating connector fixedly connected to a plurality of coaxial cables.

A coaxial cable is known in the prior art and is advantageously used for transmitting a high frequency signal. The coaxial cable comprises an inner conductor, an outer conductor surrounding the inner conductor through an insulator layer, and an outer jacket on the outer conductor. The inner conductor is used for transmitting electrical signal and the outer conductor serves for electromagnetically shielding the inner conductor. Thus, the use of the coaxial cable can avoid electromagnetic interference such as invading noise into the inner conductor from the outside and undesired radiation from the inner conductor due to the high-frequency signal flowing therethrough.

A coaxial connector is also known in the prior art for electrically connecting a coaxial cable with another coaxial cable. The coaxial connector comprises a plug unit and a receptacle unit which mutually mate. Each of the plug unit and the receptacle unit includes an inner contact element and an outer contact element connected to the inner conductor and the outer conductor, respectively, of the corresponding one of the both coaxial cables.

In order to connecting a plurality of coaxial cables with a connecting object such as a printed circuit board, a multi-coaxial connector is known in the prior art. The conventional connector includes a plurality of inner and outer contact pairs. Each of the inner and outer contact pairs comprises an inner contact element and an outer contact element surrounding, and insulated from, the inner contact element. Each of the inner and outer contact elements has a terminal portion which is fixed and connected, or soldered to a corresponding conductor, for example, a pad on the printed circuit board. A mating connector to be coupled with this multi-coaxial connector also includes a plurality of inner and outer contact pairs which are fixedly and electrically connected with inner and outer conductor pairs of the plurality of coaxial cables, respectively.

The conventional connector is mounted on the printed circuit board and the mating connector is connected and fixed to the plurality of coaxial cables. Then, the mating connector is coupled to the conventional connector, so that the plurality of coaxial cables are electrically connected to the printed circuit board.

As example of such conventional multi-coaxial connector is disclosed in U.S. Pat. No. Re. 36,065.

However, the conventional connector is composed of many parts, and requires a complicate manufacturing process, owing to the structure and the number of the parts.

SUMMARY OF THE INVENTION

This invention therefore provides the multi-coaxial connector which consists of less parts and can be readily manufactured, in comparison with the conventional connector.

According to one aspect of the present invention, a multi-coaxial connector comprises a metallic block, a plurality of contact elements, and a plurality of insulator sleeves.

The metallic block has a front end surface and a rear end surface, and is formed with a plurality of first through-holes extending in parallel with each other between the front end and the rear end of the metallic block. Such metallic block may be a die-cast metallic block.

The contact elements are disposed in the first through-holes, respectively. Each of the contact elements comprises a support portion having opposite front and rear ends, a contact portion extending from the front end of the support portion, and a terminal portion extending from the rear end of the support portion.

Each of the insulator sleeves is fitted on the support portion of each of the contact elements, while being fitted in each of the first through-holes. And thereby, the contact elements are stationarily supported in the first through-holes, respectively, in a state that the contact elements are electrically insulated from the metallic block. Thus, the contact elements and the metallic block function as coaxial inner conductors and a coaxial common outer conductor, respectively.

With this structure, the number of parts comprising the multi-coaxial connector decreases, because the metallic block is common to all of the contact elements and functions as a coaxial common outer conductor. Beside that, such connector is manufactured, by fitting the insulator sleeve on the support portion of each contact element and then inserting the contact element together with each sleeve into each first through hole of the metallic block. That is, manufacturing process becomes easy, according to one aspect of the present invention.

DESCRIPTION OF THE PREFERRED EMBODIMENTS

Prior to description of embodiments of this invention, brief description of a conventional one of multi-coaxial connectors will at first be made for a better understanding of this invention.

Figure 1:
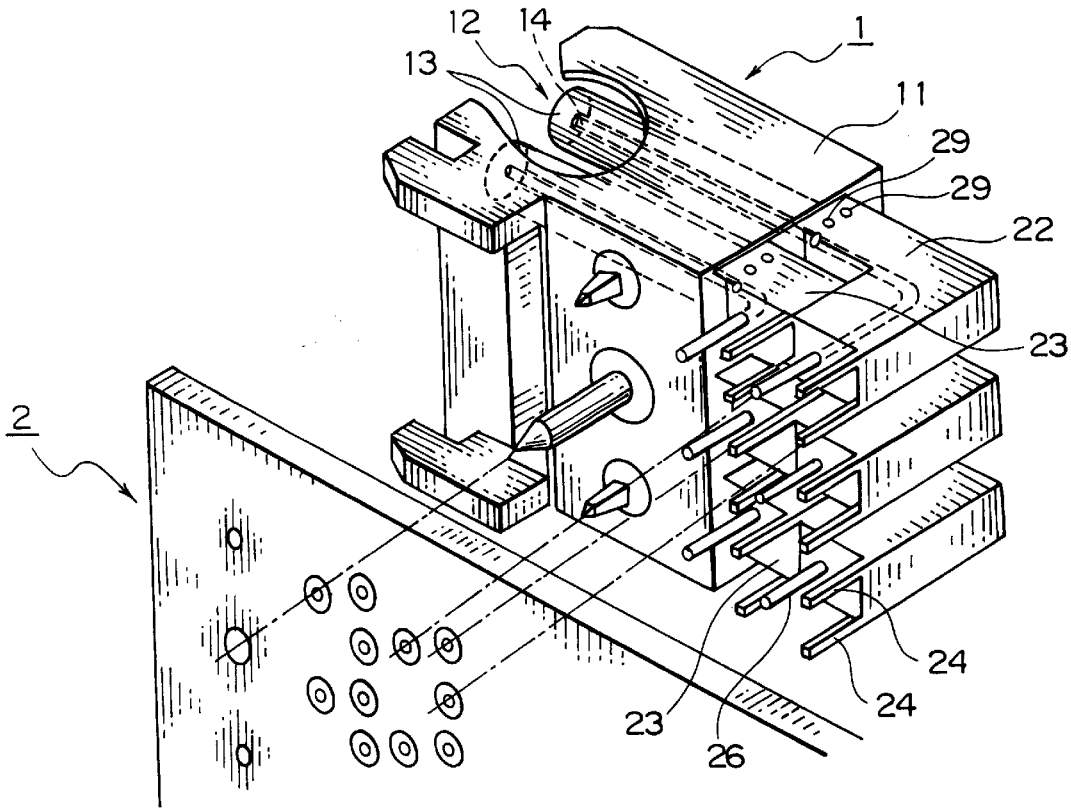
FIG. 1 PRIOR ART
FIG. 1 is a perspective view of a conventional connector, a part of which is shown broken away.
Figure 2:
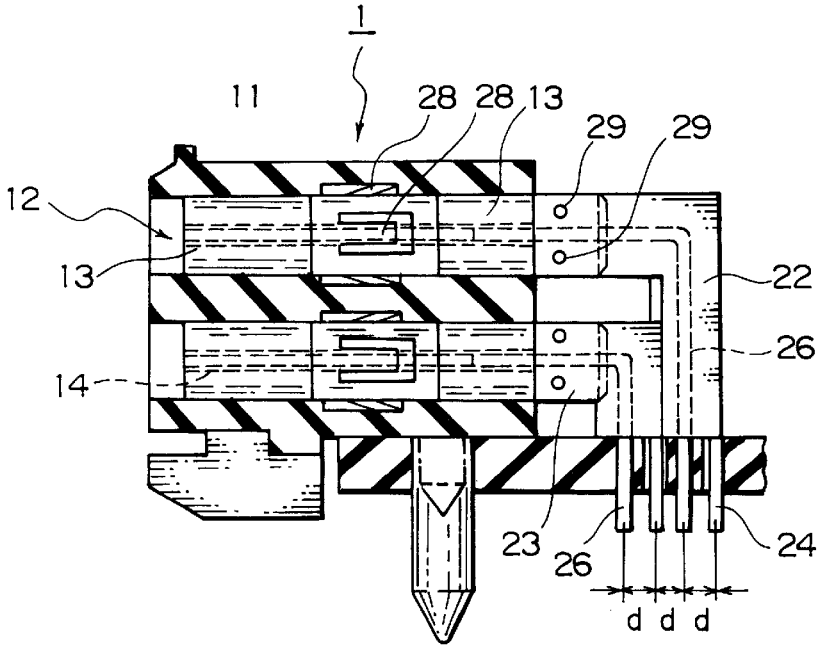
FIG. 2 PRIOR ART
FIG. 2 is a cross-sectional view of a conventional connector illustrated in FIG. 1.
Figure 3:
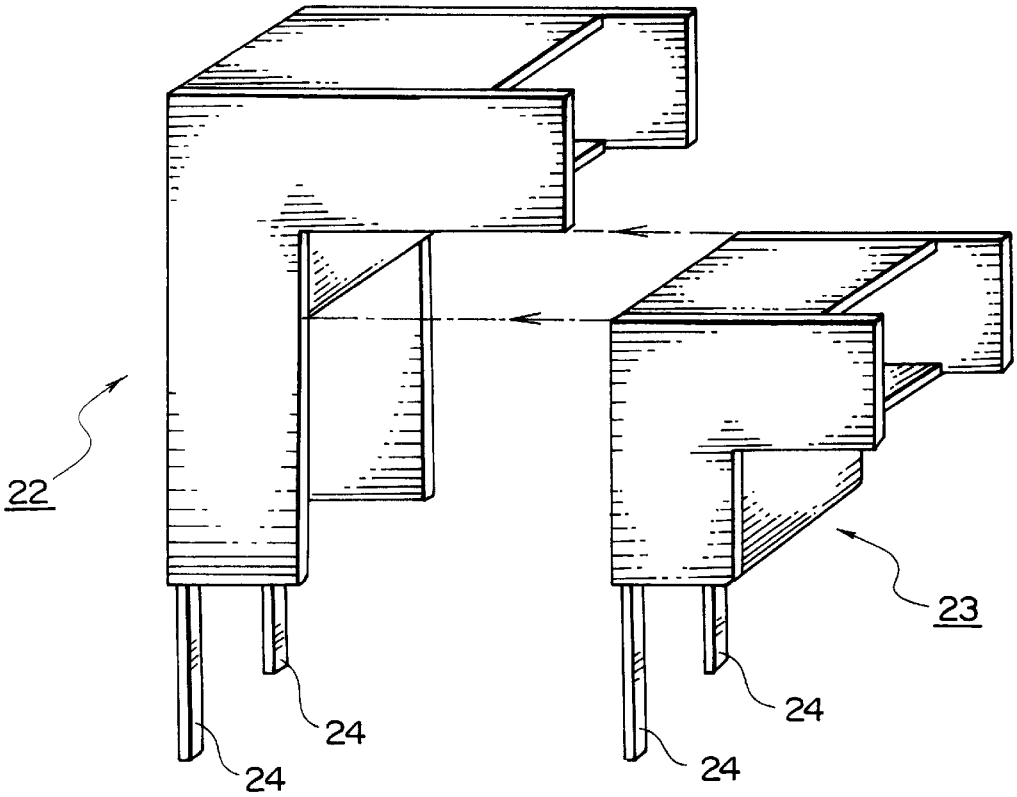
FIG. 3 PRIOR ART
FIG. 3 is a perspective and enlarged view for use illustrating L-shaped casings as outer conductors in FIGS. 1 and 2.

Referring to FIGS. 1 through 3, the conventional connector 1 is mounted on a printed circuit board 2 and comprises a housing 11, a portion of which is shown broken away. In the illustrated connector 1, the housing 11 carries two rows of three coaxial contact elements 12. Herein, the connector 1 is to be removably coupled with a mating connector, which also has two rows of three inner and outer coaxial conductor, although not shown.

Each of coaxial contact elements 12 comprises a tubular inner contact part 14 shown in broken lines, a cylindrical outer contact part 13 surrounding the tubular inner contact part 14. The cylindrical outer contact parts 13 has radially projecting lips 28 for locking the coaxial contact elements 12 to the housing 11, and are connected to L-shaped casings 22, 23. The tubular inner contact parts 14 are connected to L-shaped contact elements 26.

The L-shaped casings 22 and 23 are manufactured from sheet metal and are connected to the outer contact part 13 by means of spot welds which are diagrammatically indicated by open circles 29 in FIGS. 1 and 2. The L-shaped casings 22 and 23 are each provided with two pin-type connecting ends 24 for connecting to the printed circuit board 2. One end of the L-shaped contact element 26 is also connected to the printed circuit board 2. Thus, the conventional connector 1 can establish the connection a plurality of the coaxial cables and the printed circuit board 2, by being mounted on the board 2 and by being connected to the mating connector.

However, the conventional connector requires a pair of inner and outer contact parts 14, 15 of the coaxial contact elements 12 at every coaxial cable.

Now, explanation of a preferred embodiment of this invention will be made with reference to drawings, applying this invention to a multi-coaxial connector.

Figure 4:
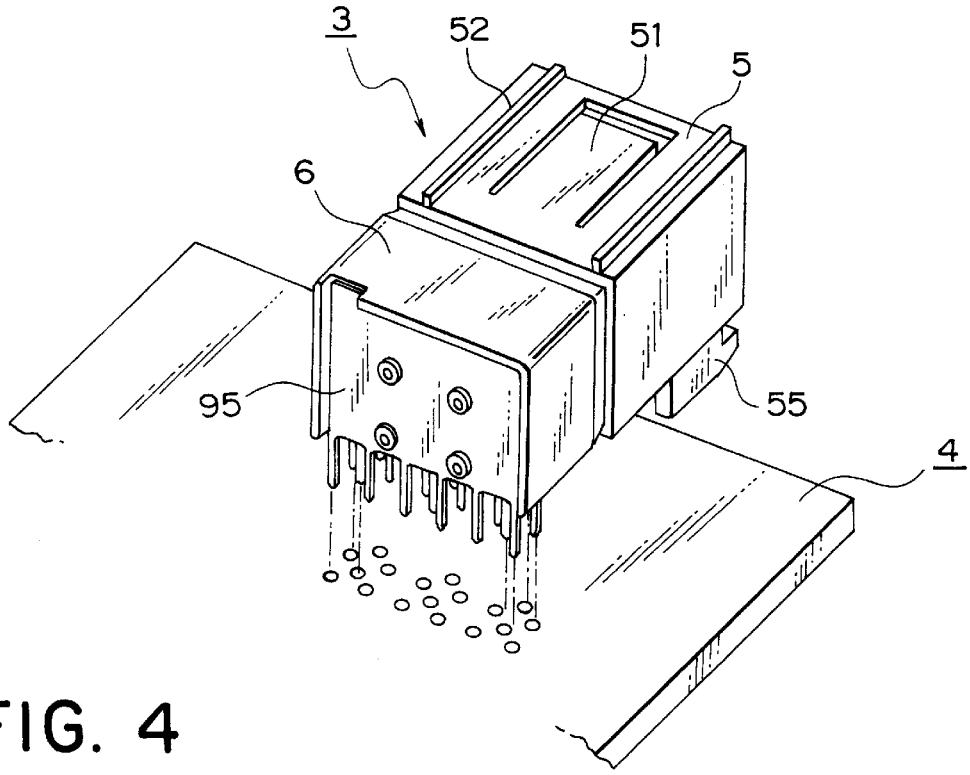
FIG. 4 is a rear perspective view illustrating a multi-coaxial connector according to a preferred embodiment of this invention, being mounted onto a circuit board.
Figure 5:
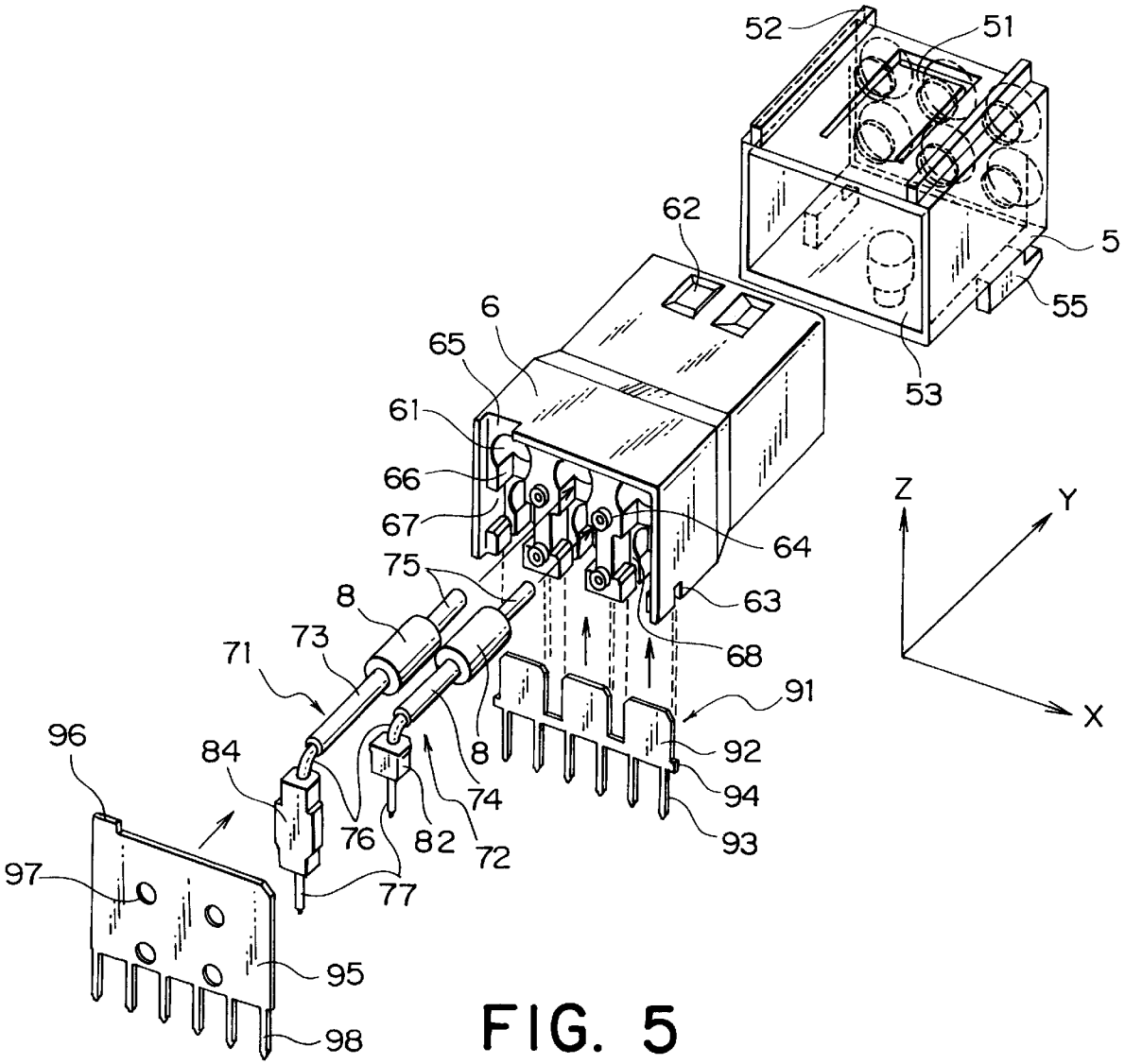
FIG. 5 is a disassembled perspective view of the connector illustrated in FIG. 6.
Figure 6:
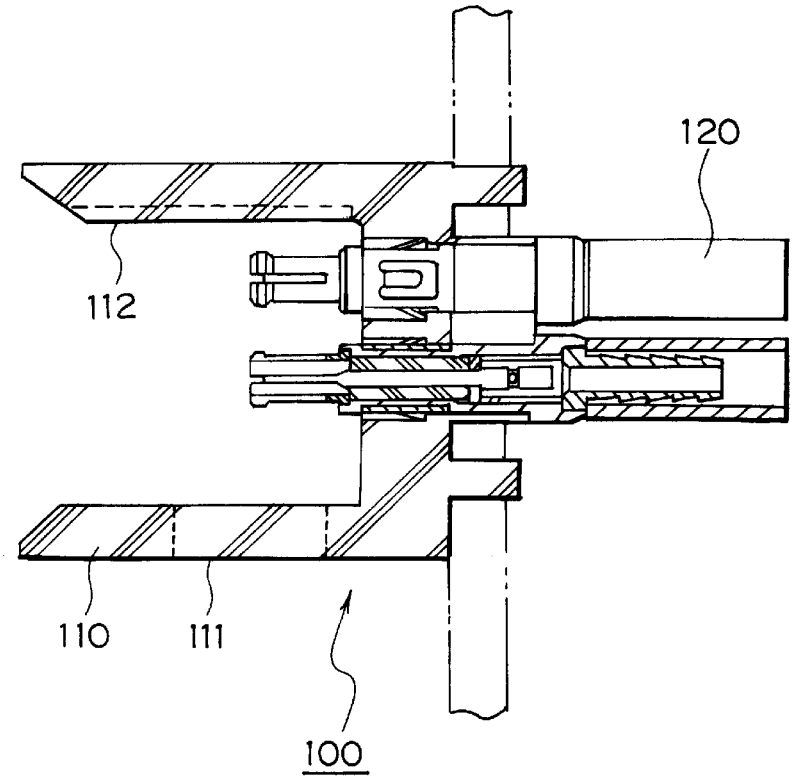
FIG. 6 is a cross-sectional view of a mating connector of the connector illustrated in FIG. 4.

Referring to FIGS. 4 and 5, a multi-coaxial connector 3 is mounted on a circuit board 4, and is coupled, at its front side, with a mating connector 100 shown in FIG. 6, which accommodates six coaxial cables 120 in this embodiment. Such multi-coaxial connector 3 comprises an insulator housing 5 with an open rear end 53, a metallic block 6 with a front end surface fitted into the housing 5 through the open rear end 53, as shown in FIG. 5. For example, the insulator housing 5 is made of plastic material.

The metallic block 6 further has a rear end surface and six through-holes 61 which are formed in the metallic block 6 to extend in parallel with each other between the front and rear ends of the metallic block 6. In this embodiment, the through-holes 61 are arranged two rows and three columns of a matrix as viewed from the rear end of the metallic block 6, as shown in FIG. 5.

The illustrated multi-coaxial connector 3 further has contact elements 71, 72 and insulator sleeves 8, both six in number.

Each of the contact elements 71, 72 has a support portion, a contact portion 75, and a terminal portion 77. The support portion has opposite front and rear ends. Especially, in order for the connector 3 to be mounted on the circuit board 4 perpendicular to the connection face of the connector 3 and the mating connector, the support portion is bent at an intermediate portion thereof. Therefore, each of the contact elements 71, 72 forms an L-shape having a foot portion 73 (74) and a leg portion, that will be referred to as an L-shaped contact element 71 (72). The contact portion 75 extends from the front end of the support portion, to form a tip of the foot portion 73 (74). The terminal portion 77 extends from the rear end of the support portion, to form a tip of the leg portion.

Each of the insulator sleeves 8 is fitted on the foot portion 73 (74) of each of the L-shaped contact elements 71 (72) and is fitted in each of the through-holes 61. Thus, the L-shaped contact elements 71, 72 are stationarily supported in the through-holes 61, in a state that the L-shaped contact elements 71, 72 are electrically insulated from the metallic block 6. Herein, the L-shaped contact elements 71, 72 function as coaxial inner conductors, while the metallic block 6 functions as a coaxial common outer conductor.

Now, further explanation, more in detail, will be made about the connector of this embodiment, together with FIGS. 7 through 11, too.

Figure 7:
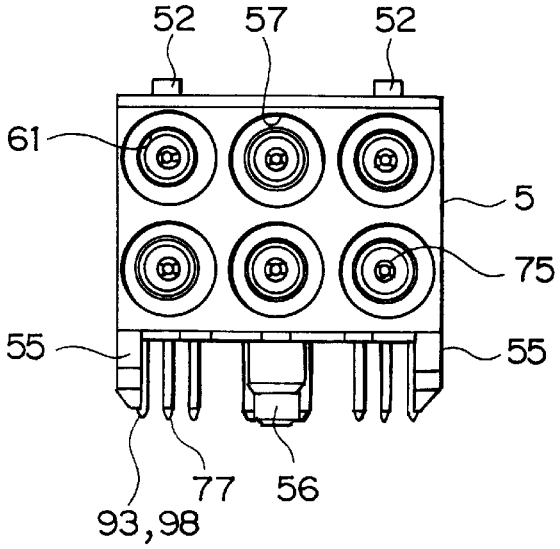
FIG. 7 is a front view of the connector illustrated in FIG. 4.
Figure 8:
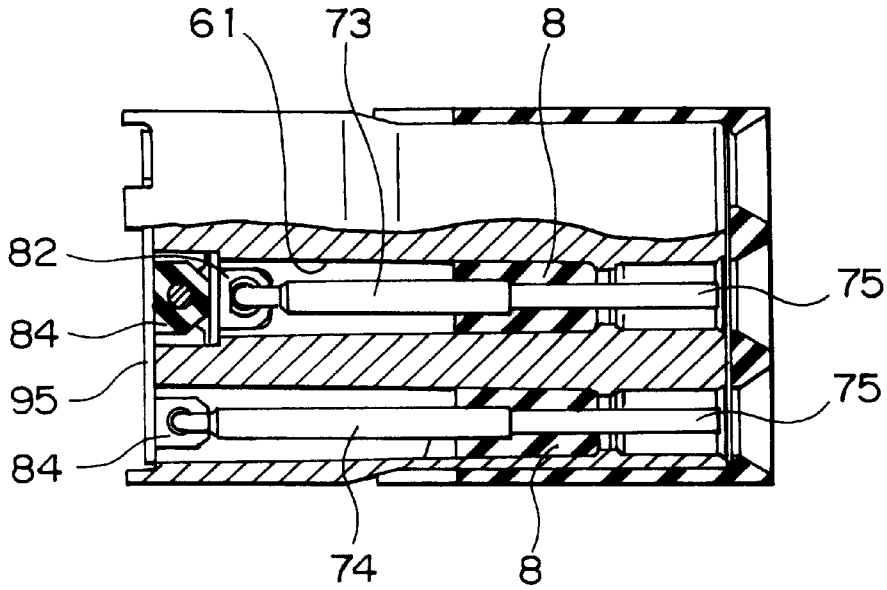
FIG. 8 is a partially exploded plane view of the connector illustrated in FIG. 4.
Figure 9:
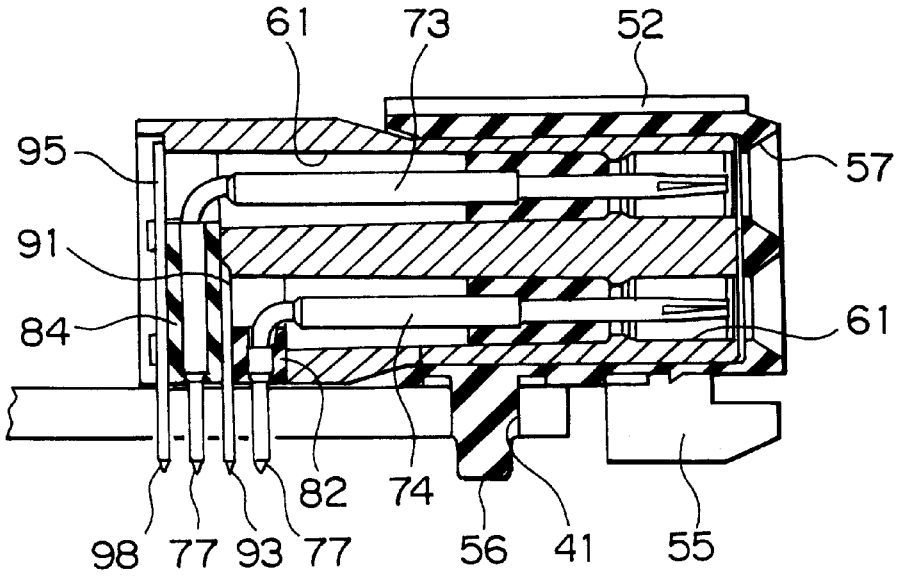
FIG. 9 is a cross-sectional view of the connector illustrated in FIG. 4.
Figure 10:
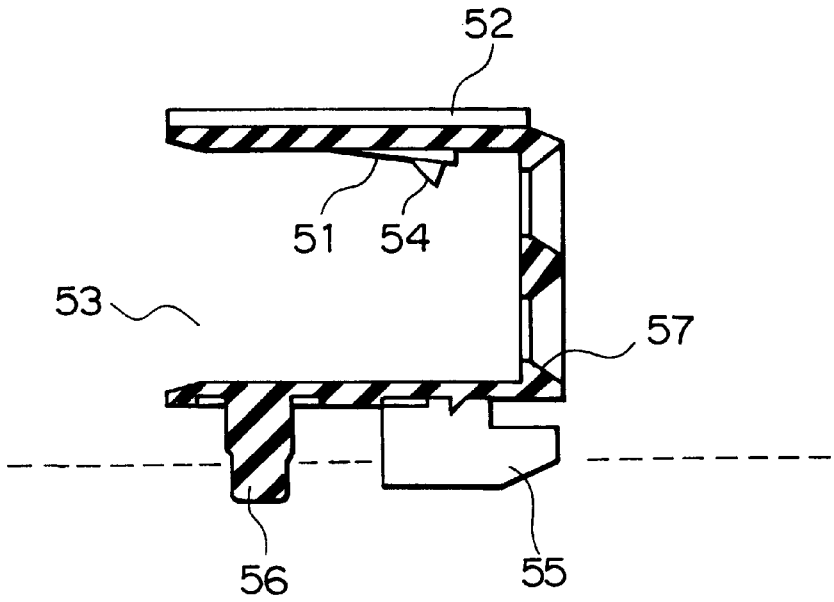
FIG. 10 is a cross-sectional view of an insulator housing of the connector illustrated in FIG. 4.

Referring to FIGS. 5, 7 and 10, the insulator housing 5 is in a box-shaped form further having a front end wall opposite to the open rear end, and an upper wall. The front end wall is formed with six through-holes 57 which extend in a front-to-rear direction and correspond to the through-holes 61 of the metallic block 6, as shown in FIGS. 5 and 7 through 10. The upper wall is formed with an elastic finger 51 having stoppers 54 projecting downwards, as shown in FIGS. 5 and 10, while depressed portions 62 are formed on an upper outer surface of the metallic block 6, as shown in FIG. 5. The depressed portions 62 receive the stoppers 54, respectively, when the insulator housing 5 is mounted on the metallic block 6 with the front end wall being disposed adjacent the front end surface of the metallic block 6. Thus, the stoppers 54 and the depressed portions 62 are fixedly engage the insulator housing 5 to the metallic block 6.

The illustrated insulator housing 5 further has two guide rims 52, two hook-type projections 55, and a connector positioning projection 56. On the other hand, the mating connector 100 has two guide grooves 112 and two slots 111 both shown in FIG. 6, and the circuit board 4 has a connector positioning hole 41 shown in FIG. 9. The guide rims 52 are formed on the upper wall of the insulator housing 5 to guide the mating connector 100, by interacting with the guide grooves 112. The hook-type projections 55 are formed at bottom of the insulator housing 5 to lock the connecting condition between the multi-coaxial connector 3 and the mating connector 100, by being engaged with the slots 111. The connector positioning projection 56 is engaged with the connector positioning hole 41 and, thereby, positions the multi-coaxial connector 3 on the circuit board 4.

In this embodiment, the metallic block 6 is a die-cast metallic block and is in a rectangular form having a bottom surface perpendicular to the rear end surface. Such metallic block 6 is provided with three grooves 66 formed in the rear end surface thereof. Each of the grooves 66 corresponds to each of the columns of the through-holes 61 and is connected to the through-holes 61 and, extends to the bottom surface of the metallic block 6. The leg portions of the respective contact 71, 72 are received in the groove 66, while the terminal portion 77 projects outward from the bottom surface of the metallic block 6.

The illustrated L-shaped contact elements 71, 72 are grouped into two types: large type and small type, that will be also referred to as large and small type contact elements, respectively. Specifically, the large type contact elements 71 are three and are disposed in through-holes 61 of upper row, while the small type contact elements 72 are three, too, and are disposed in through-holes 61 of lower row. To accommodate pairs of the large and the small type contact elements 71 and 72, the grooves 66 comprise three stairlike grooves, each of which varies in a groove depth and extends in and along the three column of the through-holes 61. In FIG. 5, a direction of the groove depth is shown as Y direction, while another direction of the column is shown as Z direction. Furthermore, the each stairlike groove 66 has a stairlike bottom of two steps corresponding to two rows of the through-holes 61, to be more in the groove depth at a position corresponding to a lower one of the two rows.

The leg portions of the pair of L-shaped contact elements 71 and 72 are received, in common, in the corresponding one of the stairlike grooves 66 but are separated from each other to leave a space therebetween in a direction of the groove depth, namely Y direction in FIG. 5.

The number of the stairlike grooves 66 may increase in accordance with the increasing of the number of columns, while the number of the steps of each stairlike groove 66 may increase in accordance with the increasing of the number of rows. Both of the increased stairlike grooves 66 and their steps can be formed in the same manner mentioned above. Furthermore, such variation of the stairlike grooves 66 allows the number of the L-shaped contact elements 71, 72 to increase.

The illustrated multi-coaxial connector 3 further comprises six insulator pieces 82, 84 which are classified into small and large types, that will be also called small and large insulator pieces hereinafter. The small insulator pieces 82 are mounted on the leg portions of the small contact elements 72, while the large insulator pieces 84 are mounted on the leg portions of the large contact elements 71. All of the insulator pieces 82, 84 are fitted in the stairlike grooves 66 at the steps thereof, respectively, so as to electrically insulate the leg portions of the contact elements 71, 72 from the metallic block 6. In detail, the small insulator pieces 82 are located in deep portion of the stairlike grooves 66, depending on the deep insertion of the small contact elements 72 into the metallic block 6.

Also, the illustrated multi-coaxial connector 3 further comprises a partitioning plate 91 disposed in the space between the leg portions of the pair of L-shaped contact elements 71, 72. In this embodiment, the partitioning plate 91 is sandwiched by the pairs of the small and large insulator pieces 82, 84, as shown in FIGS. 8 and 9. The partitioning plate 91 is made of, for example, metal material and has three protruding portions 92 protruding upwards, six pins 93 projecting downwards and two lateral projections 94 projecting to opposite side. The number of the partitioning plate 91 may increase, corresponding to the number of rows.

Each of the grooves 66 has opposite side walls 67 and opposite slits 68 in the side walls 67 to extend in a direction of the groove 66 extending, respectively. And also, the metallic block 6 further has bottom slits 63 in the bottom surface thereof to extend in a direction of the rows and to cross the grooves 66. The protruding portions 92 of the partitioning plate 91 are fitted into the opposite slits 68 and the lateral projections 94 are fitted into the bottom slits 63. Thus, the partitioning plate 91 is fixedly accommodated in the metallic block 6 with the pins 93 projecting from the bottom surface of the metallic block 6.

Moreover, the illustrated multi-coaxial connector 3 comprises a rear end plate 95 mounted on the rear end of the metallic block 6. The rear end plate 95 is made of, for example, metal material and has an engaging projection 96, four positioning holes 97 and six projecting pins 98. Herein, the metallic block 6 further has a cut-away portion 65 which is formed on an edge of the rear end surface.

The rear end plate 95 covers an entire rear end surface of the metallic block 6 with the engaging projection 96 engaged with the cut-away portion 65. Furthermore, the metallic block 6 has four positioning projections 64 which are formed on the rear end surface of the metallic block 6 and are fitted into the positioning holes 97 of the rear end plate 95, respectively. When the rear end plate 95 covers the rear end surface of the metallic block 6, such positioning projections 64 are deformed to thereby fix the rear end plate 95 to the metallic block 6.

With this structure, the number of parts comprising the multi-coaxial connector decreases, because the metallic block 6 is common to all of the contact elements 71, 72 and functions as a coaxial common outer conductor.

Figure 11:
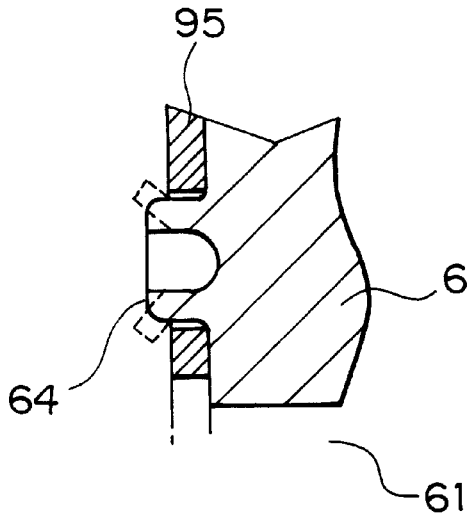
FIG. 11 is a partially enlarged cross-sectional view for use in describing of manufacturing process of the connector illustrated in FIG. 4.

Beside that, such structure of the connector 3 is easy to manufacture. In detail, manufacturing process of the embodiment comprises the following six steps:

1) fitting the insulator sleeve 8 on the support portion of the respective contact element 71, 72,
2) capping the front end surface of the metallic block 6 with the insulator housing 5,
3) inserting the small contact elements 72 together with the insulator sleeves 8 into the lower through holes 61 of the metallic block 6, respectively,
4) partitioning the stairlike grooves 66 with the partitioning plate 91,
5) inserting the large contact elements 71 together with the insulator sleeves 8 into the upper through-holes 61 of the metallic block 6, respectively, and
6) covering the rear end surface of the metallic block 6, by engaging the positioning projections 64 with the positioning holes 97, and then, by deforming the positioning projections 64, as shown in FIG. 11. That is, manufacturing process becomes easy, in accordance with the one aspect of the present invention.

What is claimed is:

1. A multi-coaxial connector comprising:

a metallic block having a front end surface and a rear end surface and being formed with a plurality of first through-holes therein extending in parallel with each other between said front end and said rear end of the metallic block;

a plurality of contact elements disposed in said plurality of first through-holes, respectively, each of said plurality of contact elements comprising a support portion having opposite front and rear ends, a contact portion extending from said front end of said support portion, and a terminal portion extending from said rear end of said support portion;

a plurality of insulator sleeves, each being fitted on said support portion of each of said contact elements, said insulator sleeves being fitted in said plurality of first through holes so that said contact elements are stationarily supported in said plurality of first through-holes, respectively in a state that said contact elements are electrically insulated from the metallic block, said contact elements and said metallic block functioning as coaxial inner conductors and a coaxial common outer conductor, respectively; and an insulator housing having an open rear end and a front end wall, said insulator housing being mounted on said metallic block with said front end wall being disposed adjacent said front end surface of said metallic block, said front end wall being formed with a plurality of second through-holes extending in a front-to-rear direction and corresponding to said first through-holes of the metallic block; wherein said metallic block is in a rectangular form having a bottom surface perpendicular to said rear end surface;

said metallic block is provided with a plurality of grooves formed in said rear end surface so that said grooves are connected to said first through-holes and extend to said bottom surface; and each of said contact elements is bent at an intermediate portion of said support portion to form an L-shape comprising a foot portion including said contact portion and a leg portion including said terminal portion, said leg portion begin received in a corresponding one of said grooves together with a corresponding one of said insulator sleeves, while said terminal portion projects outward from said bottom surface of said metallic block.

2. A multi-coaxial connector claimed in claim 1, wherein the metallic block is a die-cast metallic block.

3. A multi-coaxial connector claimed in claim 1, wherein:

said insulator housing is in a box-shaped form having an upper wall, said upper wall being formed with an elastic finger having stoppers projecting downwards; and said metallic block has an upper outer surface corresponding to said upper wall of said insulator housing, said upper outer surface being formed with depressed portions which receives said stoppers, respectively, so as to fixedly engage said insulator housing to said metallic block.

4. A multi-coaxial connector claimed in claim 1, wherein:

said first through-holes are arranged in m rows and n columns, m and n being integers, of a matrix as viewed from the rear end of said metallic block, said first through-holes being classified into m row through-hole groups each comprising n first through-holes arranged in each of said m rows and also classified into n column through-hole groups each comprising m first through-holes arranged in each of said n columns;

said contact elements are classified into m row contact groups each comprising n contact elements disposed in said n first through-holes in each of said m row through-hole groups and also classified into n column contact groups each comprising m contact elements disposed in said m first through-holes in each of said n row through-hole groups;

said plurality of grooves comprises n stairlike grooves varying in a groove depth and extending in and along said n columns, each of said n stairlike grooves having a stairlike bottom of m steps corresponding to said m rows to be more in the groove depth at a position corresponding to a lower one of said m rows;

said leg portions of said m contact elements in each of said n column contact groups are received, in common, in a corresponding one of said stairlike grooves but are separated from each other to leave spaces therebetween in a direction of the groove depth.

5. A multi-coaxial connector claimed in claim 4, further comprising:

a plurality of insulator pieces mounted on said leg portions of said contact elements and fitted in said n stairlike grooves at said steps thereof, respectively, so as to electrically insulate said leg portions of said contact elements from said metallic block.

6. A multi-coaxial connector as claimed in claim 5, which further comprises a plurality of partitioning plates disposed in said spaces.

7. A multi-coaxial connector claimed in claim 6, wherein:

each of said grooves has opposite side walls and opposite slits in said side walls to extend in a direction of said groove extending, respectively, each of said partitioning plates being fitted into said opposite slits.

8. A multi-coaxial connector claimed in claim 7, wherein:

said metallic block further has bottom slits in said bottom surface thereof to extend in a direction of said rows and to cross said grooves, and said partitioning plates have lateral projections fitted in said bottom slits.

9. A multi-coaxial connector claimed in claim 5, wherein said partitioning plates are all made of metal material and have a plurality of pins projecting downwards.

10. A multi-coaxial connector claimed in claim 5, further comprising a rear end plate mounted on the rear end of the metallic block.

11. A multi-coaxial connector claimed in claim 10, wherein:

said metallic block further has a cut-away portion formed on an edge of the rear end surface; and said rear end plate covers an entire rear end surface of said metallic block and has an engaging projection engaged with said cut-away portion.

12. A multi-coaxial connector claimed in claim 11, wherein:

said rear end plate has a plurality of positioning holes; and said metallic block has a plurality of positioning projections formed on the rear end surface of the metallic block and fitted into said positioning holes, respectively, and deformed to thereby fix said rear end plate to said metallic block.

13. A multi-coaxial connector claimed in claim 8, wherein said rear end plate is made of metal material and has a plurality of pins projecting downwards.

14. A multi-coaxial connector claimed in claim 1, wherein the insulator housing is made of plastic material.

15. A multi-coaxial connector claimed in claim 1, adapted to be connected with a mating connector of the multi-coaxial connector having guide grooves, wherein the insulator housing further has guide rims on upper surface thereof, to guide the mating connector.

16. A multi-coaxial connector claimed in claim 15, adapted to be installed on a circuit board having a connector positioning hole, wherein the insulator housing further has a connector positioning projections projecting downwards to position the multi-coaxial connector on the circuit board, by being engaged with the connector positioning hole.

17. A multi-coaxial connector claimed in claim 14, the mating connector further having a plurality of slots, wherein the insulator housing has a plurality of hook-type projections at bottom thereof, to lock the connecting condition between the multi-coaxial connector and the mating connector, by being engaged with the slots, respectively.

* * * * *